US010648227B2

(12) United States Patent
Gleeson et al.

(10) Patent No.: US 10,648,227 B2
(45) Date of Patent: May 12, 2020

(54) FLEXIBLE COVERING FOR DOOR AND WINDOW OPENINGS

(71) Applicant: ILC DOVER IP, INC., Frederica, DE (US)

(72) Inventors: Daniel James Gleeson, Harrington, DE (US); Craig Eugene Harden, South Haven, MI (US); Ryan Richard Gallagher, Milton, DE (US); Jeffrey Lewis Roushey, Milton, DE (US)

(73) Assignee: ILC DOVER IP, INC., Frederica, DE (US)

( * ) Notice: Subject to any disclaimer, the term of this patent is extended or adjusted under 35 U.S.C. 154(b) by 0 days.

(21) Appl. No.: 16/228,008

(22) Filed: Dec. 20, 2018

(65) Prior Publication Data

US 2019/0195011 A1 Jun. 27, 2019

Related U.S. Application Data

(60) Provisional application No. 62/608,999, filed on Dec. 21, 2017.

(51) Int. Cl.

| | |
|---|---|
| ***E06B 3/26*** | (2006.01) |
| ***E06B 9/02*** | (2006.01) |
| *E06B 9/00* | (2006.01) |

(52) U.S. Cl.

CPC ..... *E06B 9/02* (2013.01); *E06B 2009/007* (2013.01)

(58) Field of Classification Search

None

See application file for complete search history.

(56) References Cited

U.S. PATENT DOCUMENTS 3,151,663 A * 10/1964 Bohner ..... B60F 3/0038 160/84.02
3,359,687 A * 12/1967 Wallace ..... B64D 13/04 49/477.1
3,796,010 A * 3/1974 Carlson ..... E06B 7/2318 49/477.1
3,938,429 A * 2/1976 Perry ..... E04D 13/152 454/260
4,544,587 A * 10/1985 Nesbitt ..... B32B 3/30 428/34
4,672,888 A * 6/1987 Crombie ..... A01G 9/241 454/254

(Continued)

*Primary Examiner* — Basil S Katcheves

(74) *Attorney, Agent, or Firm* — Nixon Peabody LLP; Thomas P. Pavelko

(57) ABSTRACT

The present disclosure is directed to a flood barrier designed for the dry-flood proofing of door and window openings in a building. The flood barrier includes a rigid frame, preferably formed of metal extrusions. To this frame are clamped a water-impervious barrier and a sacrificial bladder to protect the water-impervious barrier from impacts by wind- or water-borne, debris and impacts. A number of webbings may be provided on the side of the water-impervious barrier opposite the sacrificial bladder to further support the water barrier layer. Sealing gaskets are provided on the rigid frame where the frame contacts the building, or in case of a door opening, also the floor. The sacrificial bladder permits water to accumulate between the sacrificial bladder and the water-impervious layer thereby utilizing the non-compressible nature of the water to attenuate the impacting force.

21 Claims, 14 Drawing Sheets

(56) References Cited

U.S. PATENT DOCUMENTS 5,460,462 A * 10/1995 Regan ..... E02B 3/104 405/96
5,937,595 A * 8/1999 Miller ..... E06B 3/285 52/2.11
6,029,405 A * 2/2000 Wood ..... E04H 3/14 52/2.23
6,042,301 A * 3/2000 Sovran ..... E02B 7/22 405/112
6,662,520 B1 * 12/2003 Nelson ..... E04B 1/161 52/474
6,754,997 B2 * 6/2004 Bonin ..... E04B 1/7069 52/198
6,884,002 B1 * 4/2005 Fuller ..... E02B 7/22 405/114
7,364,385 B1 * 4/2008 Luke ..... E02B 3/102 405/107
7,690,865 B1 * 4/2010 Stewart ..... E02B 3/108 405/115
7,748,169 B2 * 7/2010 Cote ..... E06B 9/02 52/2.11
2003/0102637 A1 * 6/2003 Hamel ..... E06B 9/00 277/630
2004/0253919 A1 * 12/2004 Dube ..... A01K 1/0064 454/274
2006/0257600 A1 * 11/2006 Pilaar ..... B32B 27/40 428/35.2
2007/0181271 A1 * 8/2007 Earnest ..... E04G 21/24 160/368.1
2008/0034671 A1 * 2/2008 Harrington ..... E06B 9/00 52/2.26
2008/0216416 A1 * 9/2008 Leano ..... E01F 7/00 52/2.22
2009/0145561 A1 * 6/2009 Tennant ..... E06B 9/02 160/377
2010/0083585 A1 * 4/2010 Miller ..... E06B 9/02 52/2.11
2010/0281783 A1 * 11/2010 Harrington ..... E04H 9/14 52/2.23
2012/0034032 A1 * 2/2012 Waters, Jr. ..... E02B 3/104 405/92
2016/0047102 A1 * 2/2016 Su ..... E06B 7/2318 405/107
2017/0058589 A1 * 3/2017 Williams ..... E04H 9/145

* cited by examiner

FLEXIBLE COVERING FOR DOOR AND WINDOW OPENINGS

CROSS REFERENCE TO RELATED APPLICATIONS

This application claims domestic benefit of U.S. Provisional Patent Application Ser. No. 62/608,999, filed Dec. 21, 2017, under 35 U. S. C. § 119 (e), the entire disclosure of which is herein incorporated by reference in its entirety.

FIELD

This disclosure relates to flood barriers for window and door openings in buildings and perimeter protection when used in conjunction with vertical structural posts. The flood barrier includes a rigid frame, for example, a frame of general rectilinear shape. Onto this frame is mounted a flexible textile or membrane material, such as a coated fabric that serves as the water-impervious barrier. The water-impervious barrier may be supported by structural webbings, and, in configurations of a height greater than two feet, by additional horizontal frame members. The water-impervious barrier layer can be protected by a sacrificial bladder that acts to attenuate the impact forces of wind-borne or water-borne debris. Suitable uses for the flood barriers include flood protection of building openings, such as window and door openings, in addition to perimeter protection when used in conjunction with vertical structural posts. Additional rigid frame members can be used in combination with the coverings to extend the height and width of protection. In some embodiments, the coverings are stackable: one upon another, to increase the height for which protection can be obtained against floodwaters

DESCRIPTION OF THE PRIOR ART

Flood barriers have become of particular interest in view of many destructive storms, including Hurricane Sandy in the United States in 2012, which caused massive flooding in urban areas of the East Coast of the United States, including New York City. Proposals to provide flood barriers include those disclosed in U.S. Pat. Nos. 9,267,254; 9,376,778; 9,453,314; 9,670,634; 9,702,182; 9,719,225; 9,879,393; 9,932,716; 9,951,618; and 9,985,162, the entire disclosures of which are herein incorporated by reference. While many of these proposals address the direct question of providing a water barrier in the form of a membrane or similar water impervious barrier, they do not satisfactorily address failure of the flood barrier due to water- or wind-borne debris that can cause the water-impervious barriers used in the prior art to fail structurally. Other proposals for flood barriers which address the challenge of debris are too heavy to permit easy deployment of the flood barrier. The present disclosure provides a flood barrier which prevents damage to the water-impervious barrier, while at the same time not unduly increasing the weight of the flood barrier as to impair the deployment of the flood barrier.

SUMMARY

Overview—The present disclosure is directed to a framed softgoods flood protection barrier designed for the dry-flood proofing of door and window openings, and also, as perimeter protection when used in conjunction with vertical structural posts. This flood barrier comprises a unitary or integral frame, such as a rigid aluminum frame. The rigid frame may also contain a plurality of structural webbings which will support a water-impervious barrier layer with which the structural webbing will be in contact. Over the structural webbings is mounted a water-impervious barrier layer that is supported by the structural webbings and, in configurations higher than two feet, by additional horizontal structural aluminum elements of the rigid frame. Additional cross-reinforcements can be employed as well. Furthermore, the water-impervious barrier is protected by a sacrificial bladder that is placed in front of the water-impervious barrier layer. The sacrificial barrier acts to attenuate the impact forces of wind-borne and water-borne debris. On all of the flood barrier's sealing surfaces, there are gaskets and seals installed. These gaskets and seals can be pre-compressed against the ground structure to form a water tight seal before the loading caused by floodwaters. The flood barrier is mounted to a doorway or window opening by the use of bolts to fasten the flood barrier to pre-installed female threaded anchors in the building structure on either side of the opening. For doorway applications, where a gasket or seal is required not only on vertical surfaces, but also on the horizontal ground surface, the flood barrier has a block compression mechanism on each side of vertical uprights of the rigid frame that compresses the bottom sealing gasket. When utilized as perimeter protection, the flood barrier can be joined to the series of post by bolts which pass into or through the posts.

In one embodiment, the present disclosure of a water-impervious covering combines a rigid frame with a softgoods component, such as a coated fabric water barrier, a laminate of a water-impervious membrane and a backing of fabric, a fabric impregnated with a polymer, and similar water-impervious barriers to prevent floodwaters from entering a building through window and door openings. The fabric utilized in the water-impervious covering may be woven or non-woven. If non-woven, the textile-type fibers are preferable bonded with adhesive, or heat or solvent welded at their points of contact with each other. "Softgoods" is intended to encompass all flexible water-impervious materials, whether it is a unitary element, such as a membrane, or a composite element, such as a fabric-reinforced rubber, a polymer impregnated fabric, a laminate of a membrane with a fabric backing, and similar water-impervious composites.

In another embodiment, the flood barrier comprises the water-impervious covering and further comprises a sacrificial member, such as a sacrificial bladder, in front of the softgoods component, to attenuate impacts from debris, such as wind- or water-borne debris, that might damage the softgoods in the absence of the sacrificial member. Other sacrificial members could comprise a netting fabricated of high strength textiles. It is important that the sacrificial member is secured to the structural framework such that it is not dislodged therefrom during use, especially when impacted by wind- or water-borne debris. On the other hand, it does not need to be sealed to the framework to prevent passage of water between it and the softgoods. It is important to seal the softgoods to the structural framework such that water does not pass between the softgoods and the framework, but it is not essential to seal the sacrificial member to the framework in a water tight manner. Rivets or other fasteners are sufficient to secure the sacrificial member to the structural framework.

In a further embodiment, a system for protecting buildings from water intrusion through door and window openings is provided which includes the flood barrier comprising the water-impervious covering, the sacrificial bladder and the structural framework as previously described, in combination with one or more gaskets or seals that can be pre-compressed before floodwaters act upon the flood barrier. The use of gaskets and/or seals is important in prohibiting water or other fluids from passing between the flood barrier and entering the protected premises.

In a still further embodiment, a system for protecting buildings from water intrusion through door and window openings includes the previously described flood barrier comprising the water-impervious covering, the sacrificial bladder and the structural framework as previously described, in combination with gaskets and seals, and further includes a series of bolts to connect the covering to the ground and/or the walls surrounding the window and/or door openings. These bolts act to compress the seals or gaskets used between the ground and rigid frame, as well as between the rigid frame and the walls surrounding the window and/or door opening.

These and further embodiments will be better understood when read in conjunction with the appended drawings and the detailed description of the embodiments.

DETAILED DESCRIPTION OF THE EMBODIMENTS

Figure 1A:
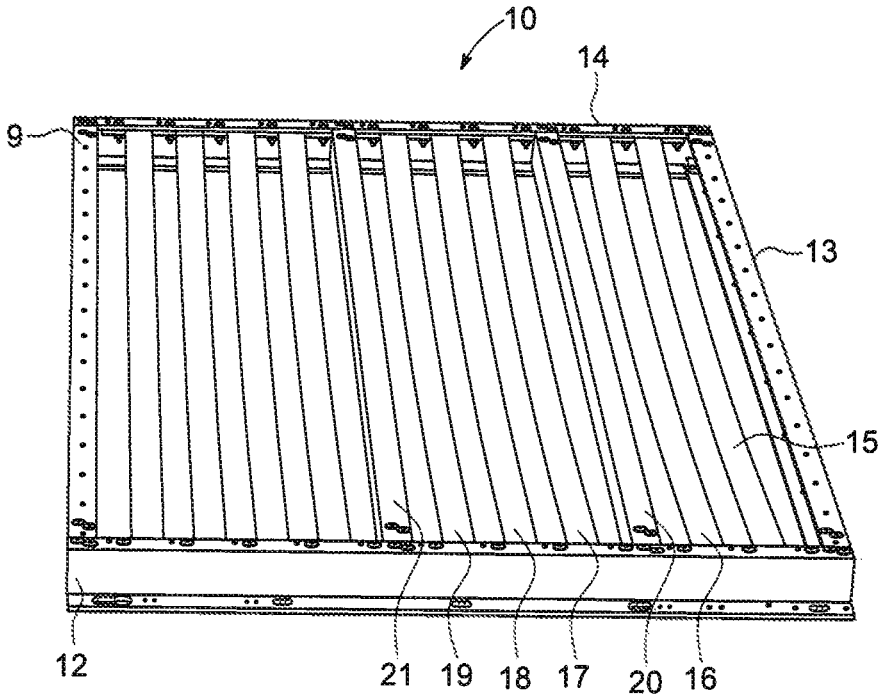
FIG. 1A is a schematic view of a rigid aluminum frame with a plurality of structural cross-webbings.

It should be understood that all the drawings are schematic and that no dimensions or relative sizes of the elements shown in the drawings should be presumed. In various views of the drawings, like elements will be referred to by the same numeral used to introduce that element in another view.

FIG. 1A discloses the steps of basic construction of the water barrier 10, where the rigid frame 9 of water barrier 10 can be formed of metal or alloy or composite. Vertical frame members 12, 14 can be extruded composite, metal or alloy, such as aluminum in an L-, I- or H- or custom shaped channel configurations. The H-shaped channel in the form of an extrudate is preferred in which the top arm of the "H" has oversize clearance holes through which foundation mounting bolts pass through to secure the flood barrier 10 to the building structure/façade. The bottom legs of the "H" are configured to interface with modified horizontal metal or alloy extrusions, such as aluminum C-shaped channel extrusions, whose role is to provide structural support to counter the inward moment loads on the flood barrier side H-shaped channel elements and to transfer the majority of the normal water (hydrostatic and hydrodynamic) loads to the building structure. The softgoods components, such as the water-impervious barrier 24 and its structural webbings support, can be clamped to the rigid frame 9. The H-shaped channel extrusions provide mounting sites for structural webbings 15, 16, 17, 18, 19, etc. The structural webbings may be connected directly to the extrusions by fasteners, or they may be clamped to the extrusions. The webbings 15, 16, 17, 18, 19, etc. are textiles or composites, preferably formed from a high strength woven fiber, webbing, straps, belts and tapes of fabric material, such as heat resistant and strong synthetic fibers, such as polyesters, and those fibers known as aramids, the best of which is poly paraphenylene terephtalamide, known as KEVLAR®. Other high strength webbing materials can also find utility, including composites combining graphite or carbon fibers and other high strength synthetic fibers. These webbings provide structural support to the water barrier against the hydro and impact loads in the vertical gaps between the horizontal aluminum structural members. A top structural member 11 and a bottom structural member 13 completes the rigid frame 9. Horizontal structural members 11 and 13 are preferably formed of C-shaped aluminum extrusions. These upper and lower members 11 and 13 aid in countering any inwardly directed forces exerted by the floodwaters. Although only an upper and a lower member 11 and 13 are illustrated, it should be understood that additional intermediate structural members 20 and 21 can be added to the rigid frame, especially where the dimensions of the flood barrier 10 exceeds 2 feet in height or 8 feet in width.

Figure 1B:
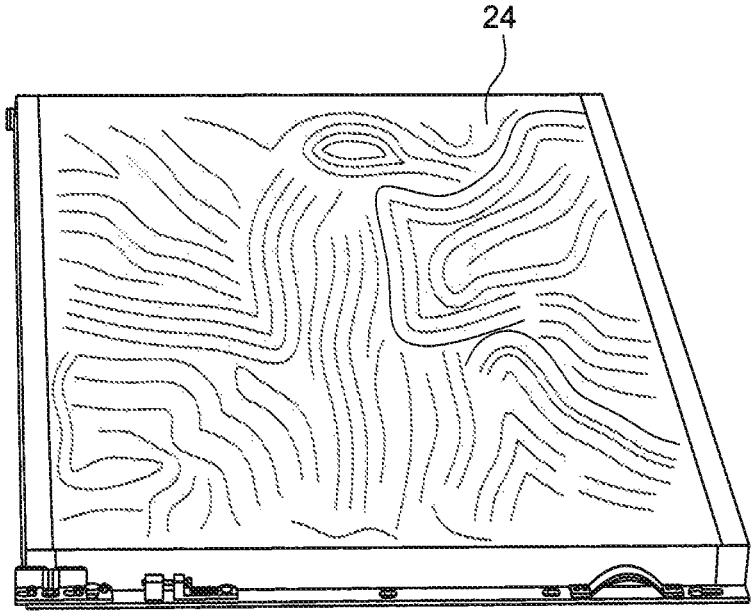
FIG. 1B is a schematic view of the rigid frame and cross-webbings of FIG. 1A, over which has been added a water-impervious barrier layer, where oversizing of the water-impervious barrier layer to permit billowing out is clearly visible.

FIG. 1B shows the placement of water-impervious barrier 24 on top of the structural webbings 15, 16, 17, 18, 19, etc. Water-impervious barrier 24 is preferably a woven fabric which has been coated to render it waterproof, although in some circumstances it may comprise a membrane. Suitable coated fabrics include coated polyester fabrics. Water-impervious barrier 24 bears against and is supported by webbings 15, 16, 17, 18, 19, etc., as well as the vertical frame members 12, 14 and the horizontal members 11 and 13, to which the water-impervious membrane is ultimately clamped. Prior to placement of the water-impervious barrier 24 on the rigid frame 9, a layer of adhesive may be placed on the periphery of rigid frame 9 so as to lie between rigid frame 9 and water-impervious barrier 24. The water-impervious barrier 24 is preferably oversized to allow for expansion. Oversizing may be achieved by a patterned or pleated shape or by any configuration which allows an increase in run length so when it billows out from the hydro- and impact loads, the water-impervious barrier 24 is not over-stressed and the loads are transferred and imparted onto the webbings 15, 16, 17, 18, 19, etc. and vertical members 12, 14 and horizontal members 11, 13, as well as any intermediate structural members 20, 21, if present. As the water-impervious barrier 24 would be subject to direct stress from impacts from wind-borne or water-borne debris that can compromise the water-impervious barrier 24 and result in abrasions, punctures and/or tears that result in leakage, a sacrificial bladder 26 is employed.

Figure 1C:
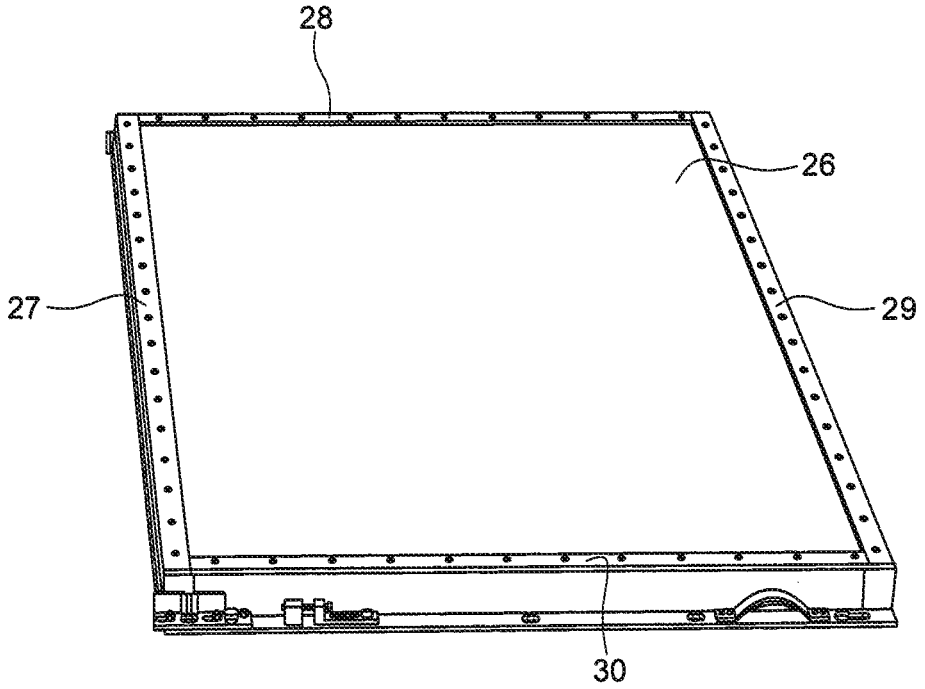
FIG. 1C is a schematic representation of FIG. 1B to which has been added a sacrificial bladder and bladder clamp.
Figure 2:
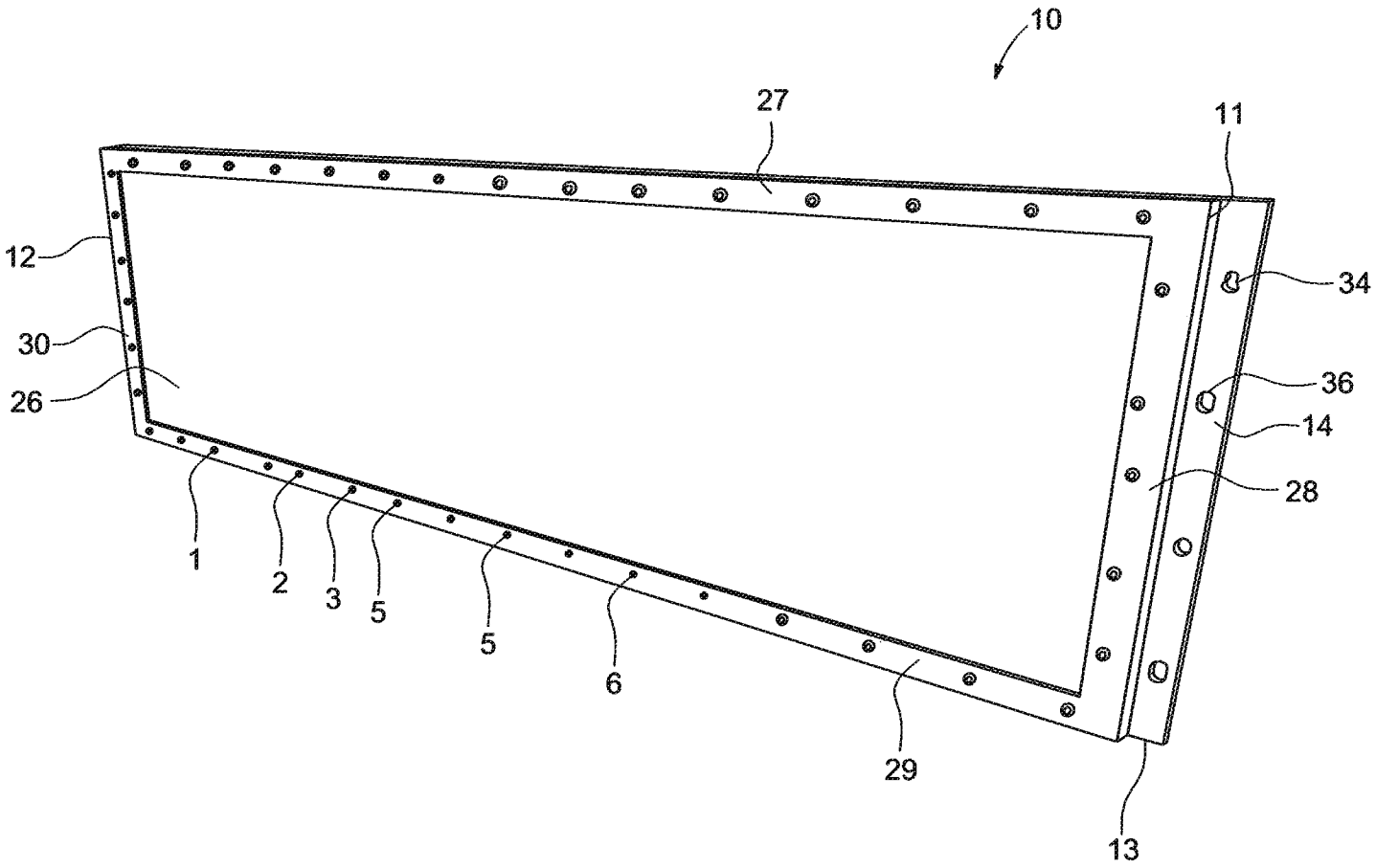
FIG. 2 is an elevation view of FIG. 1C in preparation for mounting against a building opening viewed from the challenged (flood) side.

FIG. 1C shows the placement of a sacrificial bladder 26 and a series of bladder clamps 27, 28, 29, 30 over the sacrificial bladder 26. The bladder clamps 27, 28, 29, 30 are secured to the rigid frame members as shown in FIG. 2. A series of fasteners 1, 2, 3, 4, 5, 6, etc. about the periphery of rigid frame 9 hold each of the bladder clamps to the rigid frame 9. The sacrificial barrier 26 is a flat, semi-tensioned sheet of fabric softgoods that comprises the front face of the water barrier 10. The sacrificial barrier 26 permits the entry/exit of water via cut holes or by the permeable nature of the softgoods itself. Thus, in flooded condition, a layer or water is present between the rear of the sacrificial bladder 26 and the water-impermeable barrier 24. During an impact event, the impacting object, such as wind-borne or water-borne debris, will contact the sacrificial barrier 26 first, and as the sacrificial bladder 26 is tensioned under impact, it bleeds energy away from the impacting object and reduces the impact forces, if any, that are imparted onto the water-impervious barrier 24. In addition to the attenuating properties of the sacrificial bladder 26 itself, the water trapped between the sacrificial bladder 26 and the water-impervious barrier 24, due to the incompressible property of water and the limited rate of exit back through the sacrificial bladder 26, acts as another attenuating device, spreading out the impact loads across the structural softgoods layer (webbings 15, 16, 17, 18, 19, etc. and vertical members 12, 14 and horizontal members 20, 21 of rigid frame 9). In order to further protect the sacrificial barrier 26, a layer of adhesive is interposed between along the periphery between the sacrificial barrier 26 and the bladder clamps 27, 28, 29, 30 as will be discussed further.

Figure 1D:
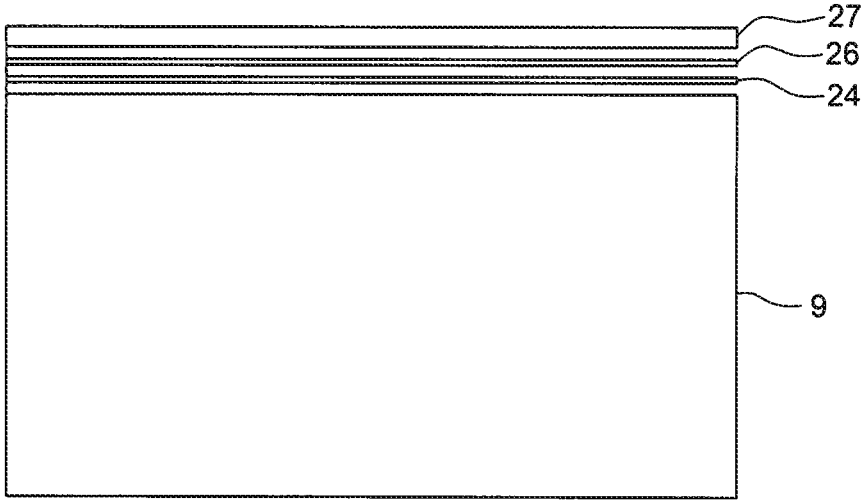
FIG. 1D is an enlarged side view of FIG. 1C to show the relative position of the water barrier layer, the sacrificial bladder and its associated bladder clamp, relative to the rigid frame.

FIG. 1D illustrates the relative position of the water-impervious barrier 24, the sacrificial bladder 26 and the bladder clamp 27 in relation to rigid frame 9. Bolts or other fasteners, such as rivets 1, 2, 3, 4, 5, 6, etc., are used to securely connect each of the bladder clamps 27, 28, 29, 30 to the respective frame members 11, 12, 13, 14 forming the rigid frame 9, thereby securing the retention of water-impervious barrier 24 and sacrificial bladder 26 to the periphery of the rigid frame 9. The water-impervious barrier 24 and sacrificial bladder 26 can also be further fastened and sealed against the periphery of the rigid frame 9 using adhesives, sealing putties or sealing tapes. The resultant water barrier 10, as seen from the challenged (flood) side is shown in FIG. 2.

Figure 3A:
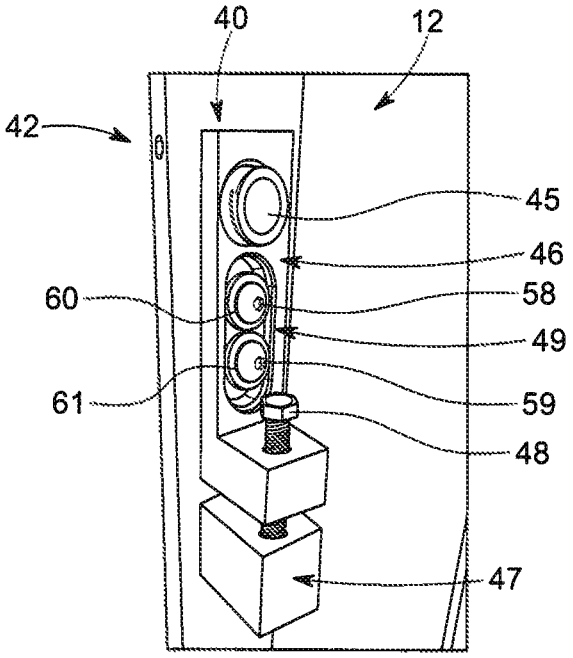
FIG. 3A is an enlarged partial elevation view of FIG. 2, illustrating the details of the block compression mechanism to cause pre-compression of a lower gasket or seal on the flood barrier before flood loading.
Figure 3B:
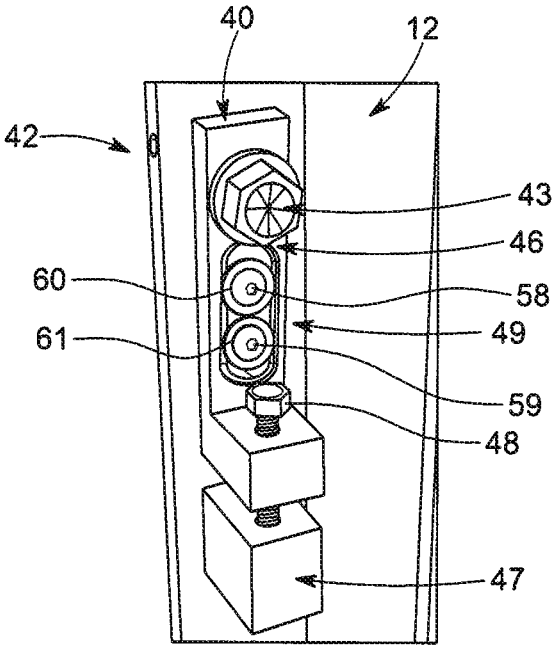
FIG. 3B is similar to FIG. 3A, but includes the installed foundation bolt to hold the rigid frame to the wall surrounding a door opening.
Figure 3C:
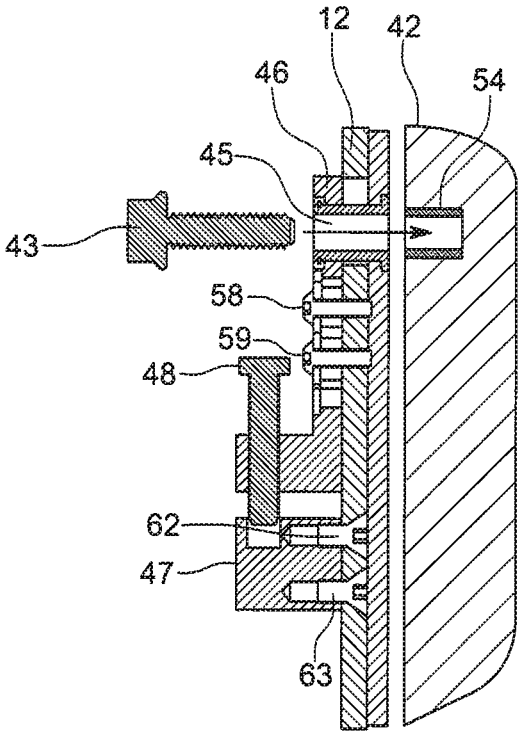
FIG. 3C is a schematic representation of a side view of FIG. 3B in preparation for inserting the foundation bolt into the wall surrounding a door opening.
Figure 3D:
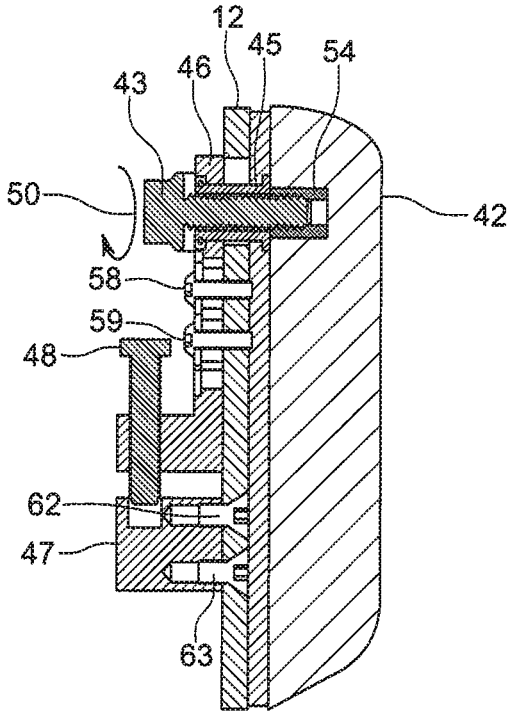
FIG. 3D is a schematic representation of FIG. 3C where the foundation bolt has been inserted and partially tightened into the wall surrounding the door securing the rigid frame to the wall.
Figure 3E:
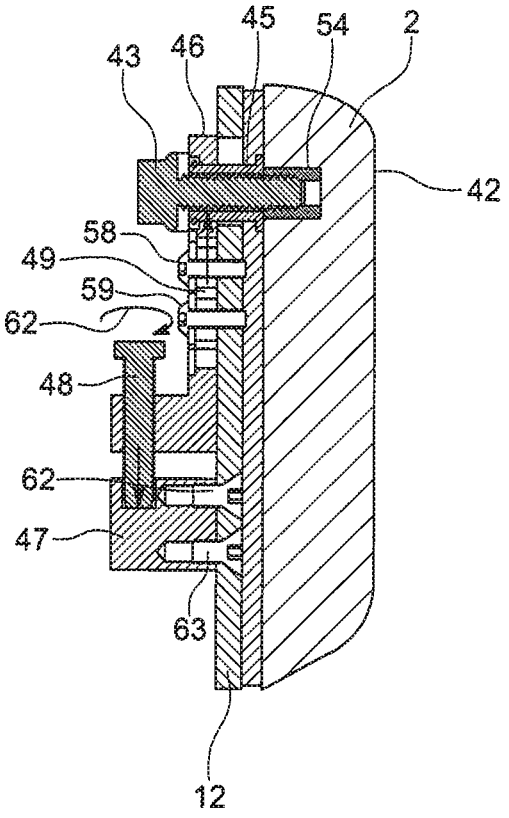
FIG. 3E is a schematic illustration of FIG. 3D, illustrating the rotation of vertical compression bolt to move the rigid frame to compress the gasket or seal between the rigid frame and the ground beneath the rigid frame.
Figure 3F:
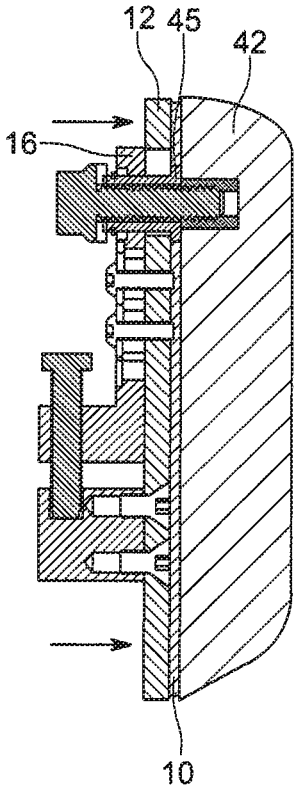
FIG. 3F is a schematic representation of FIG. 3E illustrating the torqueing down of the foundation bolts pushing the rigid frame against the wall surrounding the door thereby compressing the vertical sealing gaskets.
Figure 5:
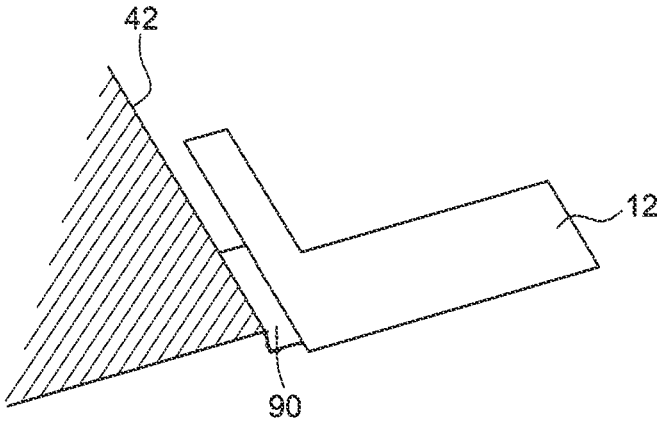
FIG. 5 is a top perspective, partially cross-sectioned view of a foundation wall of a building structure defining a door or window opening against which a gasket seal, placed on the rear of a vertical frame member, shows pre-compression of the gasket seal against the foundation wall.
Figure 6:
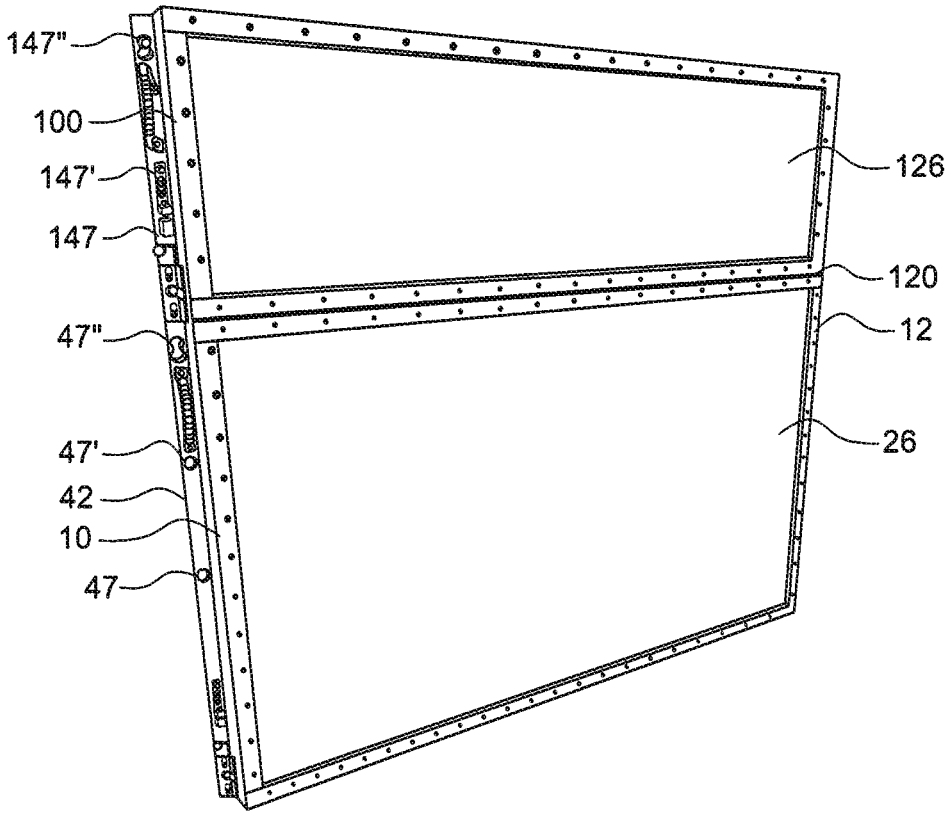
FIG. 6 is a front perspective view taken from the water challenged side of a four foot first protective covering installed in a building doorway, upon which a two foot high second protective covering is installed above the first protective covering to provide six feet of floodwater protection.

Discussion will now center on the lower gasket/seal compression feature of the flood barrier 10 in connection with FIGS. 3A-3F. As previously discussed, when flood barrier 10 is used to protect doorways or windows where the lower portion of flood barrier 10 is in contact with the ground, the inventors provide a block compression mechanism 40 for the lower gasket/seal which is carried on the lower horizontal member 13 of rigid frame 9. This gasket/seal is compressed between flood barrier 10 and the ground by the compression mechanism 40 shown in FIGS. 3A and 3B. Block compression mechanism 40 can be found on each vertical H-shaped extrusion 12, 14. For convenience only the block compression mechanism 40 is discussed in detail in connection with H-shaped extrusion 12. The flood barrier 10 is positioned adjacent the building foundation 42 surrounding the doorway or window opening to be protected as shown in FIGS. 3A and 3B. A foundation anchor 54 shown in FIGS. 3C-3E (not visible in FIG. 3A or 3B) is installed into the building foundation 42. A slider block 46 carrying bearing 45 is positioned in alignment with foundation anchor 54 so as to accept a foundation bolt 43 that will pass through an oversized clearance hole in the H-shaped extrusion 12, through bearing 45 and into foundation anchor 54 (FIGS. 3C-3E). Slider block 46 has a sliding slot 49 which permits limited vertical movement as limited by screws 58, 59 and washers 60, 61. A vertical compression bolt 48 bears against bearing block 47, which bearing block 47 is affixed to the H-shaped extrusion 12 by screws passing through H-shaped extrusion 12 and entering bearing block 47 from the rear. The method of adjusting the degree of compression on the lower gasket/seal will now be explained in connection with FIGS. 3C-3E. As shown in FIG. 3C the flood barrier 10 is positioned against building foundation 42 where the foundation anchor 54 has already been installed. Foundation bolt 43 is inserted through bearing 45 secured to slider block 46 and initially threaded into foundation anchor 54, but not tightened. FIG. 3D shows tightening foundation bolt 43 by turning in the direction of arrow 50 until anchor bolt 43 bottoms out on bearing 45. These steps are repeated on the opposing H-shaped extrusion 14. Then, as shown in FIG. 3E, vertical compression bolt 48 is threaded towards bearing block 47 by turning vertical compression bolt 48 in the direction shown by arrow 62. Being securely fastened to H-shaped extrusion 12 (and 14—not shown) the rigid frame 9 is also pushed downwards, compressing the bottom gasket/seal 74 (not visible in FIGS. 3A-3F, but shown in FIG. 5) on the horizontal ground surface. The bottom compression gasket/seal load is transferred from the slider block 46 to the bearing 45 to the foundation bolt 43 to the foundation anchor 45 and finally into the building foundation 42. These steps are repeated on the opposing H-shaped extrusion 14. Lastly, the remaining foundation bolts 47', 47", 47'" (not visible in FIGS. 3A-3F, but shown in FIG. 6) along each side of flood barrier 10 on vertical H-shaped extrusions 12, 14 are torqued down pushing the rigid frame 9 of flood barrier 10 against the foundation wall 42 and compressing vertical sealing gaskets 90 as shown in FIG. 3F and FIG. 6.

Figure 4:
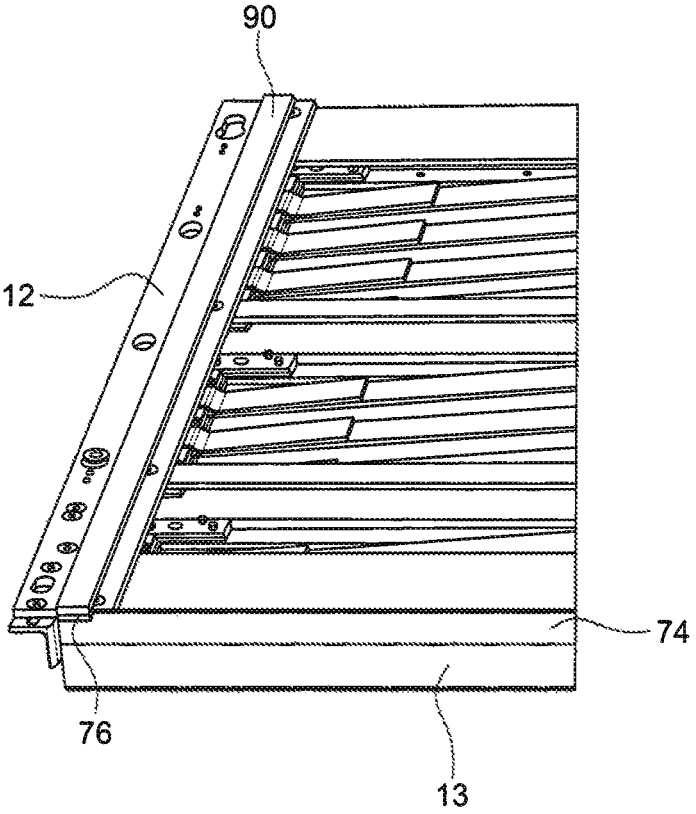
FIG. 4 is a rear view of FIG. 1A enlarged to show detail of the vertical H-shaped channel extrusion with side and bottom gasket seals attached.

Before installation of the flood barrier 10 on the building foundation 42 adjacent the door and/or window openings, a vertical sealing gasket 90 will be provided on the vertical frame members 12, 14, as well as providing a lowermost sealing gasket 74. The vertical sealing gasket 90 and lowermost sealing gasket 74 can be abutted. Alternatively, a transition sealing gasket 76 on the lower bottom structural member 13 can be used as shown in FIG. 4. Sealing gaskets are mounted to all sealing surfaces of the flood barrier 10 where the flood barrier 10 contacts the building structure and/or the horizontal ground surface for all doorway and some window applications. When sealing against both vertical surfaces and horizontal floor surfaces, the sealing gasket 74 may be wrapped around the bottom corner of the rigid frame, or a transition sealing gasket 76 is installed between the vertical sealing gaskets 90 and horizontal ground surface sealing gaskets 74. A transitional sealing gasket 76 can be used in place of wrapping the sealing gasket 74 around the corner formed between the vertical surfaces and horizontal floor surface in order to seal the corner transition. In this regard, see the transition sealing gasket 76 in FIG. 4.

It is initially envisioned that the flood barrier 10 will extend across the full width of the doorway and/or window opening that it is designed to protect. While it may be convenient to pre-stock the flood barrier 10 in a standard size format, such as a 4 foot high by 8 foot wide configuration, it should be understood by those skilled in the art to which this disclosure is directed, that the flood barrier 10 disclosed herein is scalable to protect any size window and/or door opening. The flood barrier 10 is designed to seal against both door and window openings. When sealing against windows which have vertical sealing surfaces on all sides, the sealing gaskets on flood barrier 10 are mounted on the back faces of H-shaped extrusions 12, 14 as well as on the lower horizontal member 13 and optionally on the upper horizontal member 11. The foundation bolts on both vertical sides 12, 14 are sufficient to compress the sealing gaskets against all necessary sealing surfaces as shown in FIG. 5. When sealing openings in contact with the ground, such as doorways, the sealing gaskets on the flood barrier 10 are mounted on the back sides of the H-shaped extrusions 12, 14 as previously described and the bottom face of lower horizontal member 13, so that the vertical sides and the bottom horizontal surface are all sealed. The flood barrier 10 configuration used to seal doorways where the bottom sealing surface is horizontal, the compression feature is used to pre-compress the bottom gasket against the horizontal sealing surface, as previously described in connection with FIGS. 3A-3F and then the foundation bolts 43 are used to compress the vertical side gaskets 90 against the building foundation 42. When used in perimeter protection, the flood barrier 10 is secured to upright posts firmly secured to the ground. The same manner of installation as previously described with regard to a building foundation, including pre-compression of a lower gasket sealing member can be effected, except that the flood barrier is secured to the upright posts, instead of to a building foundation.

It is also envisioned that suitable compressive sealing gaskets as used with the flood barrier 10 may be formed of any thickness, durometer and composition provided that they have sufficient properties to seal effectively for various building surfaces or to the upright posts in the event of perimeter protection. It has been found that silicone gaskets are adequate to seal most building surfaces, although in some situations, where natural stone, defects in the form of holes in the surfaces or deep mortar joints, some mechanical filling may be needed in the building surface adjacent the door and/or window opening. This is also true of the floor surface upon which sealing gasket 74 impinges.

Figure 8:
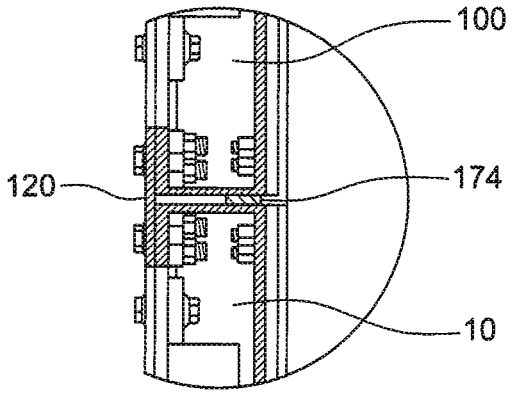
FIG. 8 is a schematic view of the interface between the first protective covering and a second protective covering stacked on top of the first protective covering as shown in FIG. 6, with a sealing gasket at the interface.

In the event that potential floodwaters are expected to exceed the height of one flood barrier 10, another or more can be stacked as shown in FIG. 6. A lowermost flood barrier 10 is installed against a foundation wall 42 defining the window or door openings of a building, as previously described. This lowermost flood barrier 10 might, in this example, have a height of 4 feet. In the event the floodwaters are expected to exceed this height, another flood barrier 100 can be stacked on lowermost flood barrier 10, and secured to foundation wall 42, in a similar manner as described in connection with how lowermost flood barrier 10 was attached to the foundation wall 42. The flood barrier 100 is, in all respects similar to the construction of flood barrier 10, as previously described. The corresponding numerals used to identify corresponding elements of flood barrier 100 to those in flood barrier 10 are the same except that a "1" is placed before the corresponding element in flood barrier 100. For example, sacrificial barrier "26" of flood barrier 10 becomes sacrificial barrier "126" of flood barrier 100. Flood barrier 100 can be of the same height as flood barrier 10, or of different height. However, it is desirable that the larger flood barrier 10 is initially placed against the horizontal ground surface. Flood barrier 100 is also provided with the pre-compression apparatus shown in FIGS. 3A-3F and described in connection with FIGS. 3A-3F. A lowermost sealing gasket 174 is provided so as to be positioned at the interface 120 of flood barrier 10 and flood barrier 100 as shown in FIG. 8. Sealing gasket 174 can be pre-compressed in the same manner that sealing gasket 74 is pre-compressed in flood barrier 10 as described above. After pre-compression of sealing gasket 174 is effected, flood barrier 100 may be fully secured to the building 42 by tightening all foundation bolts 147, 147', 147".

Figure 7:
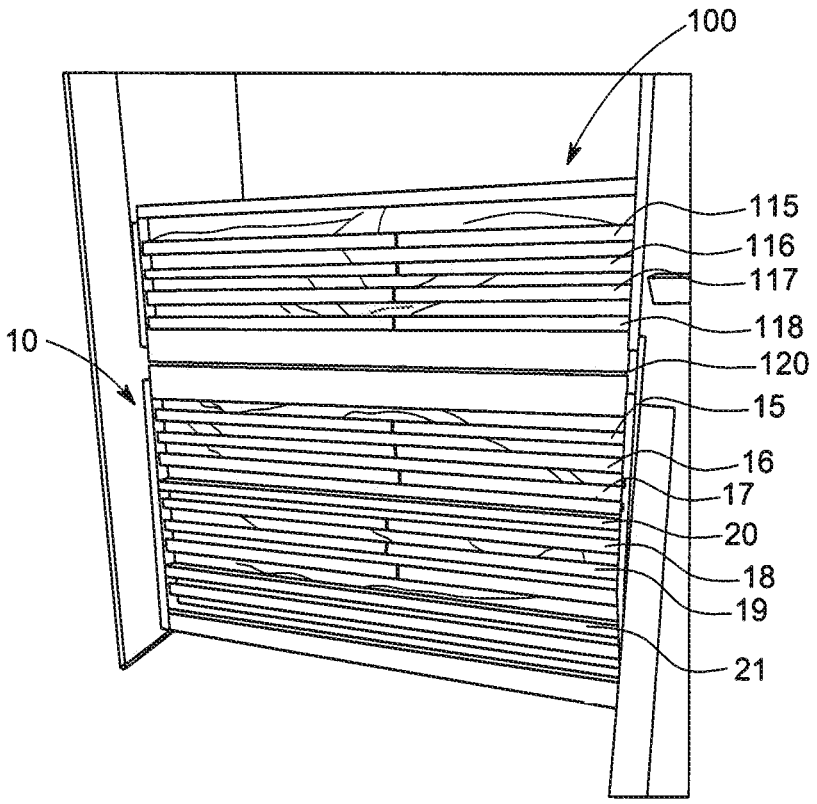
FIG. 7 is a rear perspective view of FIG. 6.

FIG. 7 illustrates the rear view of FIG. 6. Clearly shown are the webbings 15, 16, 17, 18, 19, etc. of flood barrier 10, as well as webbings 115, 116, 117, 118 of flood barrier 100. Intermediate structural members 20, 21 of flood barrier 10 are best seen in this view. The webbings of both flood barrier 10 and flood barrier 100 are both slightly bowed towards the viewer due to water loads. This slight bowing reduces the inward loads on the frame 9 due to the floodwaters to which the flood barriers 10 and 100 are expected to be subjected.

It should be expressly understood that although details of the block compression mechanism 40 have been explained with regard to only one of the vertical H-shaped extrusions 12 of flood barrier 10, it can be duplicated on each vertical member of flood barrier 10, as well as on each vertical member of flood barrier 100.

FIG. 8 is a schematic illustration, in cross-section of the interface 120 between lower flood barrier 10 and upper flood barrier 100 of FIG. 7, illustrating the sealing gasket 174 between the upper and lower flood barriers 10 and 100, respectively. Sealing gasket 174 of flood barrier 100 can be compressed utilizing the compression mechanism 140 (FIG. 6) on flood barrier 100 in the same manner as explained in connection with compression mechanism 40 detailed in FIGS. 3A-3F.

Figure 9A:
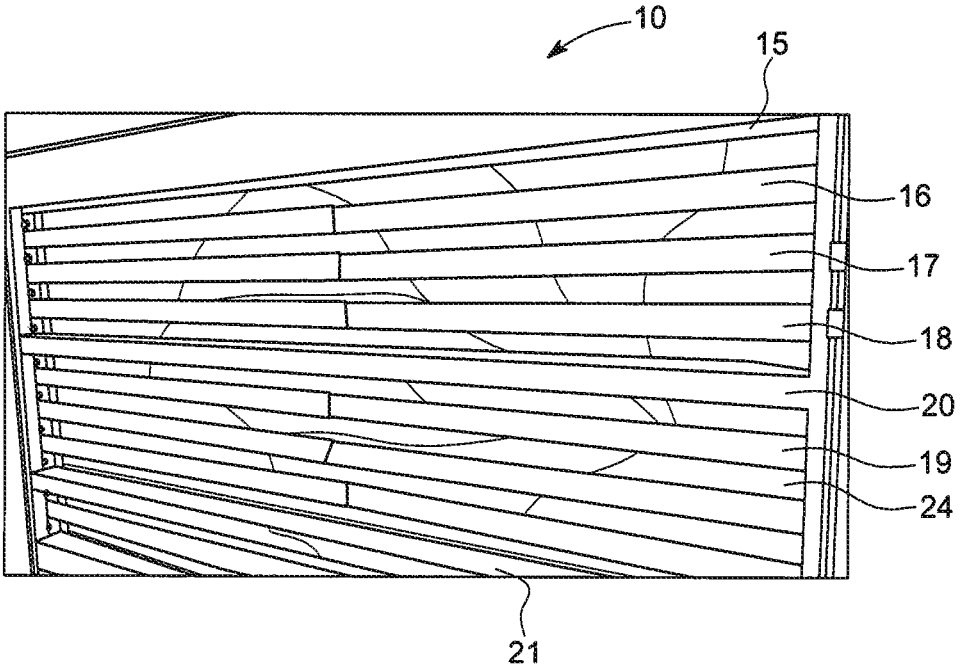
FIG. 9A is a rear view of an installed water barrier before water loading.
Figure 9B:
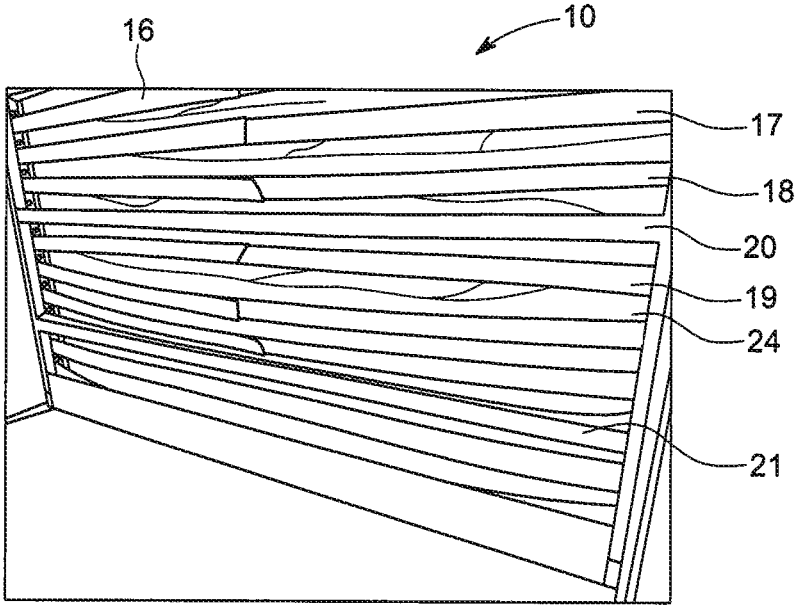
FIG. 9B is the rear view of FIG. 9A after water loading.

FIG. 9A illustrates an installed flood barrier 10 before water loading under flood conditions. It can be seen that the water-impermeable barrier 24 is oversized such that it can billow out under hydrostatic and hydrodynamic forces, reducing the loads on the frame 9 and water-impermeable barrier 24 material. FIG. 9B illustrates the water barrier of FIG. 9A under flooding conditions. The water-impermeable layer 24 has billowed out to bear against the webbings 15, 16, 17, 18 causing the webbings 15, 16, 17, 19 and others to elongate under load. The oversizing of the water-impermeable barrier 24 allow it to bear against the elongated webbings without causing rupture thereof.

It should be understood that although various steps of construction and installation of water barrier 10 and 100 have been described in a sequence, that description was as an aid to the reader and there should not be considered as a limitation on the manner of construction or installation. Steps or portions of the construction and installation may be performed in other sequences than those described herein without departing from the spirit of the appended claims.

It will be understood to the ordinary worker skilled in the art to which this disclosure is directed that various other embodiments, and variations on the disclosed embodiments, may be made without the use of inventive effort. All the various embodiments disclosed herein are exemplary only and should not be viewed as limiting the disclosure.

We claim:

1. A flood barrier for door and window openings of a building, said flood barrier comprising:

a rigid frame formed of metal or alloy or composite members in combination with softgoods; the rigid frame comprising an assembly of the members, and the softgoods are mounted to the rigid frame; an outer peripheral surface of the rigid frame defining an area;

the softgoods comprising a water-impervious barrier; and, a sacrificial bladder positioned on one side of the water-impervious barrier;

the sacrificial bladder comprising a plurality of holes therein;

wherein the water-impervious barrier is mounted upon the assembled members defining the outer peripheral surface while spanning the area and sealed to the rigid frame in a water tight manner such that water does not pass between the water-impervious barrier and the rigid frame;

wherein the sacrificial bladder is laid over the water-impervious barrier while also spanning the area with the holes in the bladder permitting entry of water through the bladder so as to be captured between the water-impervious barrier and the sacrificial bladder; and, a series of bladder clamps, the bladder clamps clamping the sacrificial bladder to the assembled members comprising the rigid frame.

2. The flood barrier of claim 1, wherein the water-impervious barrier is a membrane.

3. The flood barrier of claim 1, wherein the rigid frame comprises H-shaped channel extrusions as vertical members.

4. The flood barrier of claim 3, further comprising a plurality of structural webbings spanning the area, the structural webbings connected to the H-shaped channel extrusions, the webbing being positioned against the water-impervious barrier on a side of the water-impervious barrier opposite the sacrificial bladder.

5. The flood barrier of claim 3, wherein the vertical members are each provided with a vertical sealing gasket, the vertical sealing gasket being placed upon the H-shaped extrusion on a side of the H-shaped extrusion opposite to the side of the H-shaped extrusion in contact with the water-impervious barrier.

6. The flood barrier of claim 1, wherein the rigid frame comprises at least one horizontal member formed of C-channel or L-channel shaped extrusions.

7. The flood barrier of claim 6, wherein the at least one horizontal member comprises at least a lowermost horizontal member of the rigid frame and wherein the at least lowermost horizontal member further comprises a horizontal sealing gasket, wherein the horizontal sealing gasket is positioned on the at least lowermost horizontal member so as to be in contact with a ground surface when the flood barrier is positioned to protect a door or window opening of a building.

8. The flood barrier of claim 1, wherein the water-impervious barrier comprises a water-impervious coated fabric.

9. The flood barrier of claim 8, wherein the water-impervious barrier is oversized such that it can billow out under hydrostatic and hydrodynamic forces.

10. The flood barrier of claim 1, wherein the sacrificial bladder has permeable features in order to permit floodwaters to accumulate between the sacrificial bladder and the water-impermeable barrier.

11. A flood barrier for door and window openings of a building, said flood barrier comprising:

a rigid frame formed of metal or alloy or composite members in combination with softgoods; wherein the rigid frame comprises at least one horizontal flanged member formed of C-channel or L-channel shaped extrusions; wherein the at least one horizontal member comprises at least a lowermost horizontal member of the rigid frame and wherein the at least lowermost horizontal member further comprises a horizontal sealing gasket;

the softgoods comprising a water-impervious barrier; and, a sacrificial bladder positioned on one side of the water-impervious barrier; said flood barrier further comprising a block compression mechanism mounted upon at least one of the vertical members of the rigid frame to pre-compress the horizontal sealing gasket before the flood barrier is subjected to hydrostatic forces.

12. The flood barrier of claim 11, wherein the block compression mechanism comprises a vertical bolt rotatably positioned and mounted on a sliding block, wherein the sliding block is mounted on at least one of the vertical members and by bearing the vertical bolt against a fixed block mounted to at least one of the vertical members, the vertical member exerts a compressive force on the horizontal sealing member to pre-compress the horizontal sealing gasket before the flood barrier is subjected to hydrostatic forces.

13. A method of preventing flood water from entering a building through at least one door or window opening by installing a flood barrier comprising:

a rigid frame formed of metal or alloy or composite members, the rigid frame being combined with softgoods attached to the rigid frame;

the softgoods comprising a water-impervious barrier; and, a sacrificial bladder positioned on one side of the water-impervious barrier to span across at least one of a door or a window opening of a building;

by attaching the rigid frame to the building with fasteners passing through holes in vertical members of the rigid frame; and, tightening the fasteners to compress vertical sealing gaskets between the vertical members and the building.

14. The method of claim 13, wherein the building opening is a door opening, the method further comprising pre-compressing a sealing gasket between the rigid frame and the ground.

15. The method of claim 14, further comprising preventing damage to the water-impervious barrier from waterborne debris by allowing flood water to pass through the sacrificial bladder and become partially retained between the water-impervious barrier and the sacrificial bladder, thus serving as an impact energy dissipating element.

16. The method of claim 15, wherein the step of pre-compressing the sealing gasket between the rigid frame and the ground comprises advancing a vertical bolt mounted on a sliding block positioned on the vertical member of the rigid frame to bear upon a fixed block attached to the vertical member to apply a pre-compressive force to the sealing gasket.

17. The method of claim 16, further comprising causing the advancing vertical bolt mounted upon the sliding block causes the sliding block to bear against the mounting bolt into the building wall.

18. A flood barrier for preventing the passage of floodwater about a perimeter, said flood barrier comprising:

a rigid frame formed of metal or alloy or composite members, the rigid frame being combined with softgoods; the rigid frame comprising a peripheral surface upon which is mounted the softgoods; the peripheral surface defining an area;

the softgoods comprising a water-impervious barrier; and, a sacrificial bladder positioned on one side of the water-impervious barrier;

wherein the water-impervious barrier is mounted upon the peripheral surface while spanning the entire area and sealed to the rigid frame in a water tight manner such that water does not pass between the water-impervious layer and the rigid frame;

wherein the sacrificial bladder is laid over the water-impervious layer while also spanning the entire area; and, a series of bladder clamps, the bladder clamps clamping the sacrificial bladder to the rigid frame;

the rigid frame being positioned between supporting vertical posts.

19. The flood barrier of claim 18, further comprising a plurality of rigid frames, each of such rigid frame being supported by supporting posts and further comprising a seal to seal the rigid frame to one of a post or to another rigid frame.

20. A flood barrier for door and window openings of a building, said flood barrier comprising:

a unitary rigid frame formed in combination with softgoods; the softgoods are mounted to the rigid frame; the outer peripheral surface of the unitary frame defining an area;

the softgoods comprising a water-impervious barrier; and, a sacrificial bladder positioned on one side of the water-impervious barrier;

the sacrificial bladder comprising a plurality of holes therein;

wherein the water-impervious barrier is mounted upon the rigid frame while spanning the area and sealed to the rigid frame in a water tight manner such that water does not pass between the water-impervious barrier and the rigid frame;

wherein the sacrificial bladder is laid over the water-impervious barrier while also spanning the area with the holes in the bladder permitting entry of water through the bladder so as to be captured between the water-impervious barrier and the sacrificial bladder; and, a series of bladder clamps, the bladder clamps clamping the sacrificial bladder to the rigid frame.

21. The flood barrier of claim 20, further comprising structural webbings which contact and support the water-impervious barrier.

* * * * *